US005644297A

United States Patent [19]

Masi et al.

[11] Patent Number: 5,644,297

[45] Date of Patent: Jul. 1, 1997

[54] PERSONAL PROTECTION DEVICE

[76] Inventors: J. Roger Masi, 55 State St., Hackensack, N.J. 07601; William F. Hall, 158 Harvest La., Lincoln Park, N.J. 07035

[21] Appl. No.: 645,810

[22] Filed: May 14, 1996

Related U.S. Application Data

[63] Continuation-in-part of Ser. No. 280,392, Jul. 26, 1994, Pat. No. 5,517,180.

[51] Int. Cl.[6] ..... G08B 23/00

[52] U.S. Cl. ..... 340/573; 340/574; 340/693; 222/613

[58] Field of Search ..... 340/573, 574, 340/693, 321; 222/613, 509, 78, 3, 39, 94, 103, 113, 175, 192; 200/61.93, 61.86; 116/DIG. 44, 211, 2, 4, 77

[56] References Cited

U.S. PATENT DOCUMENTS

| | | | |
|---|---|---|---|
| 3,794,791 | 2/1974 | Thomson | 340/321 |
| 4,121,736 | 10/1978 | McGaw, Jr. | 222/94 |
| 4,241,850 | 12/1980 | Speer | 222/39 |
| 4,322,194 | 3/1982 | Roberts | 222/103 |
| 4,449,474 | 5/1984 | Mariol | 116/2 |
| 4,581,021 | 4/1986 | Landau et al. | 222/103 |
| 4,716,402 | 12/1987 | Francis | 340/321 |
| 4,990,327 | 2/1991 | Neirinckx | 222/945 |
| 5,011,044 | 4/1991 | Brown | 222/175 |
| 5,052,590 | 10/1991 | Ratcliff | 222/94 |
| 5,065,904 | 11/1991 | McCaffrey et al. | 222/3 |
| 5,137,178 | 8/1992 | Stokes et al. | 222/103 |
| 5,325,085 | 6/1994 | Decker | 340/574 |

*Primary Examiner*—Jeffery Hofsass
*Assistant Examiner*—Benjamin C. Lee
*Attorney, Agent, or Firm*—Sheldon H. Parker

[57] ABSTRACT

A personal protection device is disclosed with a mixing area and mixing nozzle. A fluid container rests on a moveable container base having a nozzle which extends into the mixing area. The fluid container can be a two portion flexible ampule or a canister. A two part glowing fluid is used, which is mixed prior to expulsion from the device. An irritative substance is placed in one of the mirror image sections. A compression device is maintained in a non-compressed position when unarmed and is activated by a trigger and locking device. A battery receiving area is connected to the internal electronics, trigger, alarm and light. A moveable safety latch is proximate the trigger preventing access to the trigger when in the unarmed position and allows access when in the armed position. A safety cap is held in the unarmed position by a reset bar. A plug portion in the safety cap is dimensioned to fit within mixing area nozzle. By placing the safety laatch in the armed position and depressing trigger, the locking device is released. The compression device is activated, releasing the safety cap and expelling the contents of the container.

19 Claims, 7 Drawing Sheets

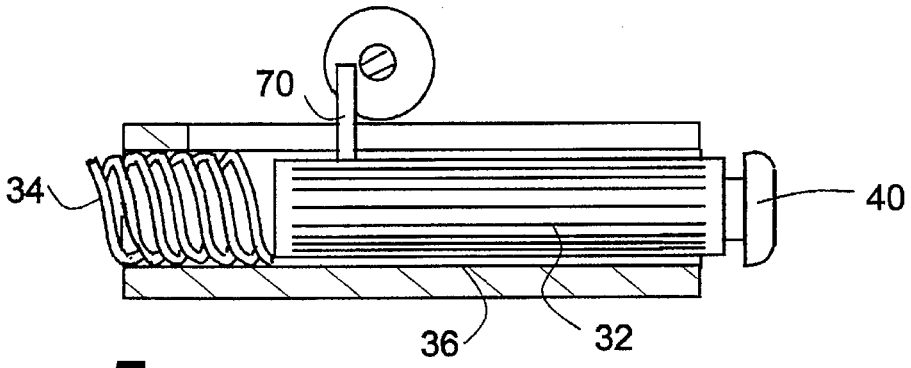
Figure 5a
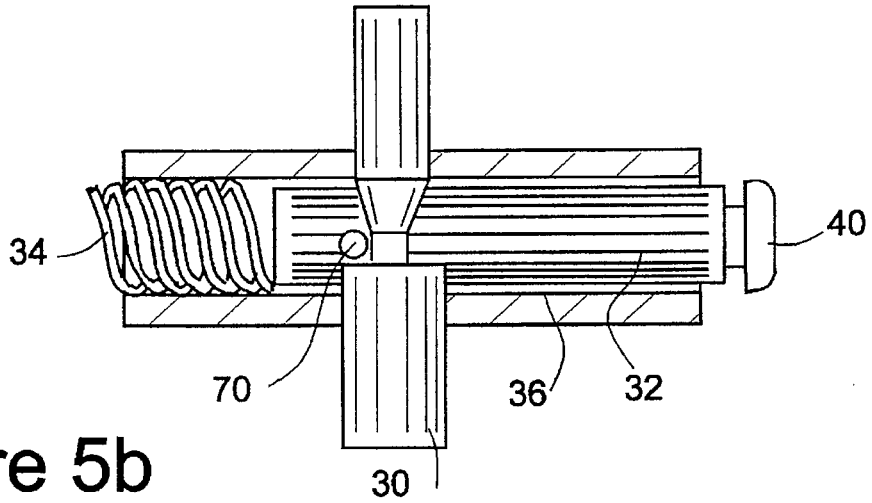
Figure 5b
Figure 5c
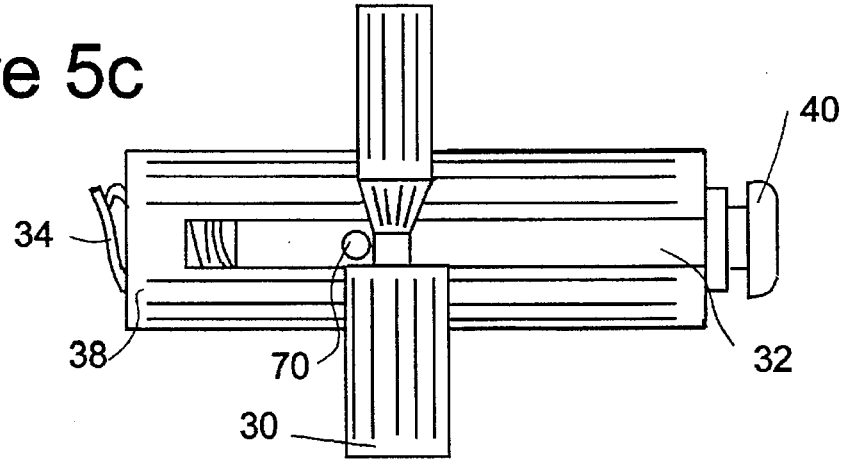

Figure 8
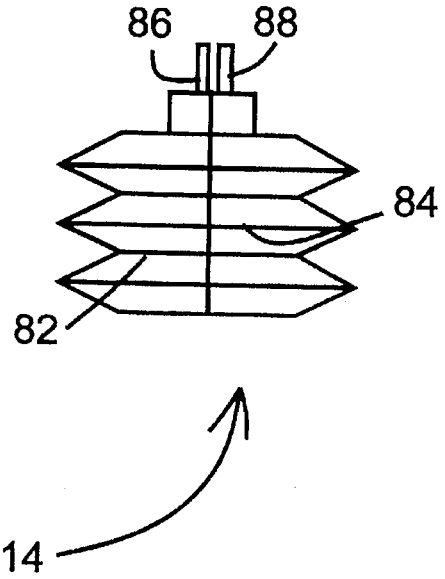
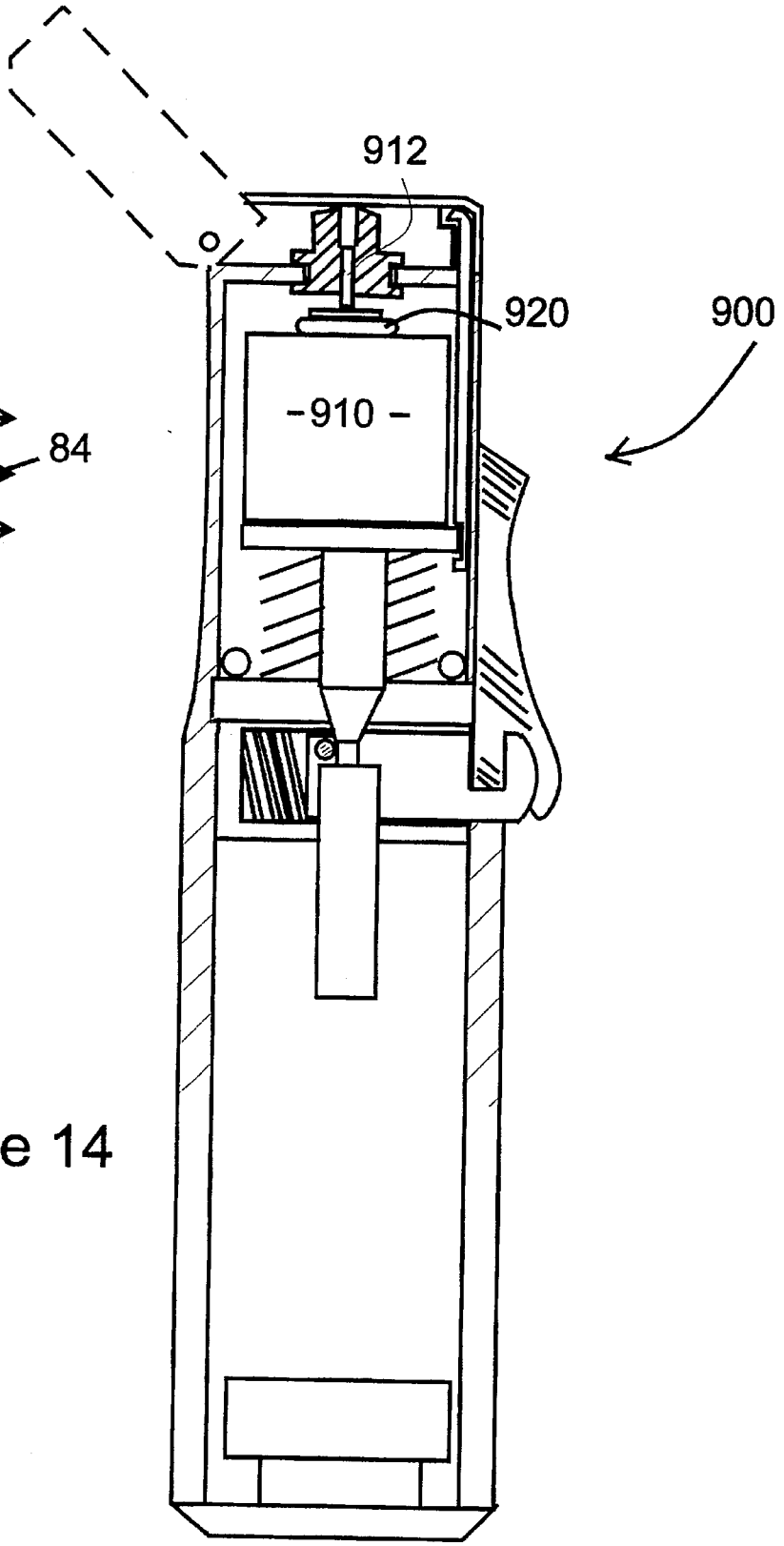
Figure 14

PERSONAL PROTECTION DEVICE

RELATE BACK TO PRIOR APPLICATION

This invention is a continuation-in-part of U.S. Ser. No. 08/280,392 filed Jul. 26, 1994 and issued as U.S. Pat. No. 5,517,180 on May 14, 1996.

BACKGROUND OF THE INVENTION

1. Field of the Invention

The instant disclosure relates to a convenient, hand held personal protection device which provides additional protection through multi-layering its defenses and alarms.

2. Brief Description of the Prior Art

With the increasing prevalence of violent crime is an acute need for a personal protection device that is safe, easy to use, and compact. Sales of typical defensive sprays, such as Mace, have increased dramatically in the last several years. The media coverage of violent crimes, particularly rapes and muggings against women, have heightened the fear that women, as well as men, feel in conducting their personal or business affairs in urban or suburban areas. Not only have the media extensively covered the wave of violent crime in this country, but the increases in violent crime have been documented statistically. In New Jersey, for example, violent crime rose 67% since 1974. Among juveniles, violent crimes increased 69% in that twenty year period and arrests of juveniles for weapons offenses rose 60% last year alone. A personal protection device, therefore, will serve the dual purpose of both protecting the potential victims and easing anxiety with the knowledge that an attacker can be effectively deterred by the device.

Various personal protection devices have been devised to deter attackers. In U.S. Pat. No. 5,032,824 to Corbin, a hand held alarm is disclosed which sounds a high intensity light and loud horn. The Corbin device, however provides no physical deterrent to the attacker. In a remote area, an attacker may gamble that no one will hear the alarm or, alternatively, he can finish the attack prior to anyone's arrival.

U.S. Pat. No. 4,967,684 to Vidovic et al discloses a loud audio alarm system for a ski-pole to locate lost skiers. Again, there is no physical deterrent to the attacker.

U.S. Pat. No. 5,086,377 to Roberts discloses a defense baton which incorporates audible and visible alarms with a defense spray. Carrying the baton, however, would be awkward and would be obvious to a potential attacker. The obviousness may dissuade some potential attackers, however many may simply alter their attack to render the baton ineffective.

Novak, in U.S. Pat. No. 5,289,164 discloses a glove which incorporates a signal and spray retardant. The device, although providing a physical deterrent, is not readily put on and removed.

U.S. Pat. No. 4,449,474 to Mariol discloses a personal security device which utilizes a two piece telescoping housing. The device incorporates a manual whistle, flash cube and pressurized gas. The odorous pressurized gas may also include a paint or stain. When the pressurized gas is expelled it emits a shrieking noise. The Mariol patent provides the advantage over many prior art patents in that it incorporates a deterrent to the attacker. However, the skrieking noise appears to be a continuous sound, which may be mistaken for other sounds. The flash cube provides only one opportunity to visually blind the attacker. The Mariol patent does not allow for any misses. The sound is only emitted during the spraying of the gas and the light is only a rapid flash.

In U.S. Pat. No. 4,846,044 an electric stun gun using electrically conductive fluid is disclosed. The stun gun disclose although effective, is not portable to the extent that it will fit into a pocket or purse. A more portable stun gun is disclosed in U.S. Pat. No. 4,843,336 to Kuo. The stun gun also incorporates a siren and strobe light. The stun gun, however requires a proximity to the assailant which may not be desirable.

The prior art does not provide a small, convenient, multilayered personal protection device. The instant invention discloses a device that combines multiple layers of defense against potential attackers, together with small size, safety and convenience of use.

SUMMARY OF THE INVENTION

A personal protection device is disclosed which contains a body section having a first end and a second end. A container section is contained proximate the first end of the body. A mixing area is proximate the first end and has a mixing nozzle extending through the first end. A fluid container, containing a irritative substance, such as pepper spray, rests on a movable container base and has a nozzle which extends into the mixing area. The fluid container can be a flexible ampule or a canister. The flexible ampule preferably comprises two mirror image sections, each with a nozzle extending into the mixing area. A two part glowing fluid is used with one part being placed in one of the mirror image sections and the second being placed in the second mirror image section. The glowing fluid is mixed in the mixing area prior to expulsion from the device. The irritative substance is also placed in one of the mirror image sections. A compression device, such as a spring, is positioned proximate said container base and is maintained in a non-compressed position by locking means. A trigger is proximate, and interacts with, the locking means. A light, preferably an intermittent strobe, is proximate the first end. A battery receiving area is proximate the locking means and accessible to change the batteries. An alarm is connected to the internal electronics. The electronics are also connected to the battery receiving area, trigger and light. Preferably both the light and the alarm are intermittent. A movable safety latch is proximate the trigger and prevents access to the trigger when in the unarmed position and allowing access to said trigger when in the armed position. A safety cap is held in the unarmed position by a reset bar, which is in contact with the compression device. Preferably the safety cap includes a spring hinge. A plug portion in the safety cap is dimensioned to fit within mixing area nozzle.

By placing the safety means in the armed position and depressing trigger, the locking means is released. The compression device is activated, compressing the container and releasing the safety cap, thereby expelling under force the contents of the container into the mixing area and out of the protection device.

At least a portion of the body is removable to allow access to the fluid container and battery receiving area. Preferably the light and alarm pulse simultaneously. The electronic can immediately activate the light and alarm means or, alternatively, delay activation of the light and alarm by a predetermined time period.

BRIEF DESCRIPTION OF THE DRAWINGS

The advantages of the instant disclosure will become more apparent when read with the specification and the drawings, wherein:

FIG. 5 is a cutaway top view of the trigger and stop of the device of FIG. 1;

FIG. 5*a* is a cutaway side view of the trigger of FIG. 5;

FIG. 5*b* is a cutaway side view of the trigger of FIG. 5 illustrating stop the channel;

FIG. 8 is a cutaway side view of the ampule of FIG. 1;

FIG. 14 is a cutaway side view of an alternate embodiment of the protection device of the instant invention using a spray canister.

DETAILED DESCRIPTION OF THE INVENTION

The design of the instant personal protection device provides a number of advantages over the prior art. The device is a non-lethal defensive weapon that is easily used and provides a high degree of protection against a potential attacker. The device is capable of being stored and carried for long periods of time without losing it effectiveness. Since the device is not a lethal device, its accidental triggering or its usage by unauthorized individuals or children would not cause permanent damage. In fact, since the device, in the preferred embodiment, contains only one pepper spray and glowing fluid emission, as opposed to multiple emissions in the standard Mace devices, the device is thereby rendered safer in the hands of unauthorized individuals. The instant device is inexpensive to manufacture, thereby making it readily available to the majority of consumers.

Figure 1:
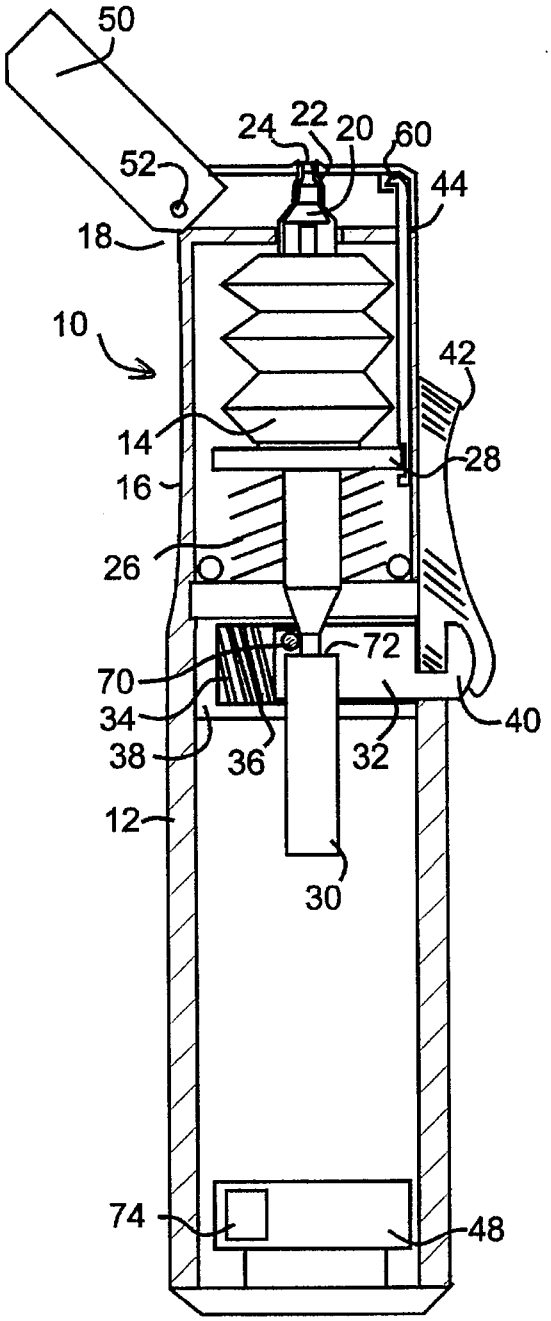
FIG. 1 is a cutaway front view of the protection device of the instant invention armed for use.

Prior art defensive sprays are generally rather large and bulky, and vary greatly in size and volume in order to offer the ability of the victim to spray the device on a repeated basis. The likelihood, however of a victim shooting more than one spray while under attack is very slight. The preferred embodiment of the instant device provides a single application spray, thereby enabling the device to be easily hand held. The personal protection device 10 is illustrated in FIG. 1 and, as illustrated herein, is substantially rectangular. This is not intended to limit the scope of the invention and any configuration, or material, can be substituted which meets the criteria disclosed herein. The contents of the personal protection device 10, as well as the alternate embodiments, are encased in a shock resistant case 12 which preferably has approximately a one inch diameter and four inch length. Although not illustrated in FIG. 1, the shock resistant case can have safety bumpers encircling the top and bottom of the device 10 to resist impact. The safety bumpers can be manufactured from hard rubber or other suitable materials which will protect the case 12. The case 12 uses a high impact shock resistant plastic to prevent breakage of the case 12, or its contents, in the event the device 10 is thrown on the ground or stepped on. Alternatively, an aluminum or other metal case can be used, dependent upon cost of manufacture and aesthetics.

The personal protection device contains an accordion shaped ampule 14 which rests on movable ampule base 16. The ampule 14 preferably contains two separate halves, as illustrated in more detail in FIG. 8, although a single chamber ampule can be used in the protection device 10. In the preferred embodiment, the ampule 14 contains a left chamber 82 and a right chamber 84, one holding the pepper spray and one part of a glowing fluid, the other half containing the other part of the glowing fluid. The glowing fluid utilized is described in further detail hereinafter. The each of the chambers 82 and 84 have a nozzle 86 and 88 respectively, which is referred to collectively in FIG. 1 as open nozzle 18. The nozzles 86 and 88 which allow for the ampule 14 contents to be released into the mixing chamber 20 of the ampule coupler 22. The ampule coupler 22 seals and couples together the left chamber 82 and right chamber 84 of the ampule 14. Since the glowing fluid requires mixing prior to expulsion, the mixing chamber 20 provides the area in which to mix, and therefore activate, the two fluids. When a single ampule construction is used, the ampule can contain, as an example, one of the following combinations: (1) pepper or mace fluid alone, (2) pepper or mace fluid with an oxygen activated marking, non-glowing dye, (3) pepper or mace fluid with an oxygen activated glowing fluid, (4) pepper or mace fluid with an oxygen activated glowing fluid and marking dye (5) marking, non-flowing dye alone, and (6) oxygen activated glowing fluid alone.

The ampule base 16 is adjacent an ampule spring 26, which is located between the ampule base 16 and the spring base 28. The spring base 28 is nonmoveably affixed to the case 12 and therefore serves as a stationary support for the spring 26. A brace 38 is provided with a trigger receiving channel 36. The ampule plunger 30 extends through the trigger rod 32, the spring base 28, brace 38 and the center of the spring 26 to be in contact with the ampule base 16. Prior to use, the ampule plunger 30 is in the locked position, as shown in FIG. 1, allowing for the full extension of the filled ampule 14. The ampule plunger 30 is maintained in the locked position by the spring loaded plunger stop pin 70. The trigger spring 34 maintains the trigger rod 32 in the locked position by maintaining pressure against the rod 32 and back of the trigger receiving channel 36.

Figure 3:
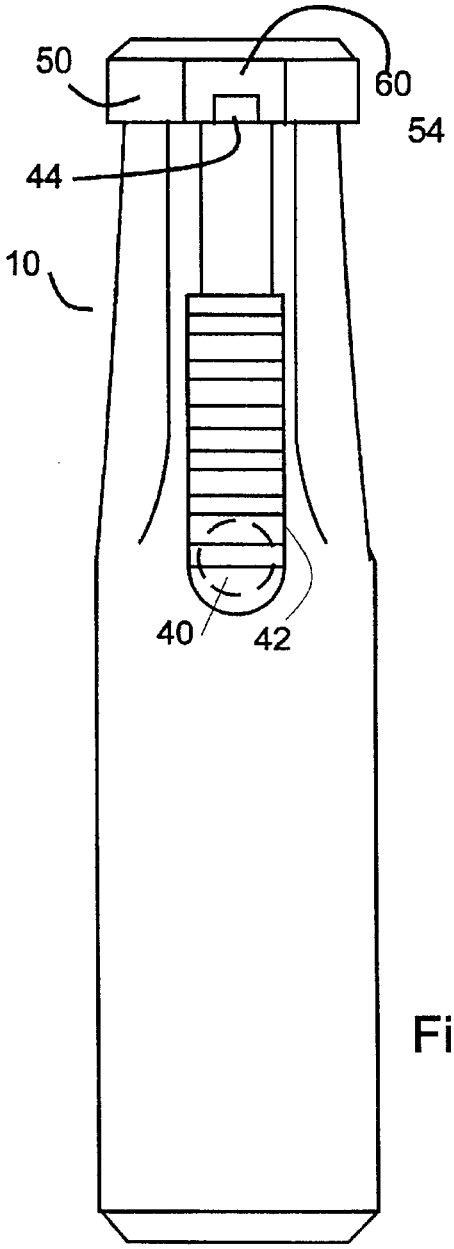
FIG. 3 is a side view of the device of FIG. 1.

The spring loaded trigger 40 extends beyond the outer surface of the case 12 and is protected from inadvertent activation by sliding lock 42. In the preferred embodiment, the sliding lock 42 is provided with a depressed area to receive the user's thumb, also shown in FIG. 3. A lock or catch, as known in the art, should be provided to prevent the sliding lock 42 from freely moving. The sliding lock 42 allows for the protection device 10 to be held, armed and activated with one hand. This allows the user's other hand to be free for defense, holding possessions, opening doors, etc.

The reset bar 44 extends along the interior side of the case 12 and serves to reset the ampule plunger 30 once it has been released. The reset bar 44 is designed to move in conjunction with the ampule base 16 and can either be an integral part of the base 16 or removably affixed through use of a friction fit, screw of other means known in the art.

Figure 2:
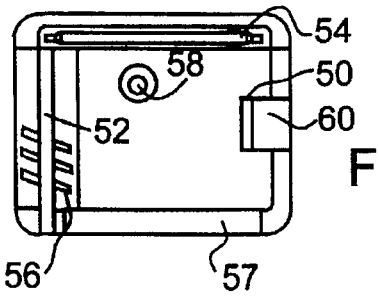
FIG. 2 is a top view of the protection device of FIG. 1.

The cap 50 pivots on hinge 52 and is illustrated in more detail in FIG. 2. The hinge 52 is spring loaded through use of spring 56 and is maintained in the closed position through use of the reset bar 44. The cap 50 is automatically released upon depression of the trigger 40, as described in greater detail hereinafter. The cap 50 extends only a portion of the top of the device, thereby leaving the strobe 54 exposed at all times. The strobe 54 is protected by a crack-resistant lens to prevent accidental breakage of the bulb. Alternatively, the cap can extend over the strobe, only exposing the strobe upon activation. The strobe light flash tube 54 preferably has a brightness sufficient to temporarily impair the vision of an attacker, as well as act an an indicator signal. The placement of the strobe light 54 in the top of the device 10 aims the strobe light 54 at the attacker's eyes as the user aims the spray at the attacker's face. A depressed detent 60 interacts with the release bar 44 thereby maintaining the lid 50 in the locked position until opened by the user through depression of the trigger 40. The cap 50 is further provided with a rubber stopper 58 which is positioned to fit within the ejection nozzle 24. This prevents any leakage of the fluids when the cap 50 is closed.

A speaker 48 for the alarm is, in the embodiment illustrated herein, at the bottom of the device 10, although the configuration can vary as will become apparent to one skilled in the art. The speaker 48 is connected to a 110 decibel alarm 74, which is preferably a 110 DB piezo which emits a piercing, varying sound timed to correspond with the strobe light 54. In the preferred embodiment, the device 10 emits the light and sound pulse simultaneously in an intermittent manner, thereby creating a sound signature that is more readily heard. The intermittency also allows both the light and sound to be produced longer and brighter by lessening the drain on the batteries. Optimally, the light and the sound would pulse for a duration of one-quarter of a second at a rate of once per second. This time duration allows the sound and light to pulse for a minimum of twenty (20) minutes using the batteries incorporated herein.

Figure 4:
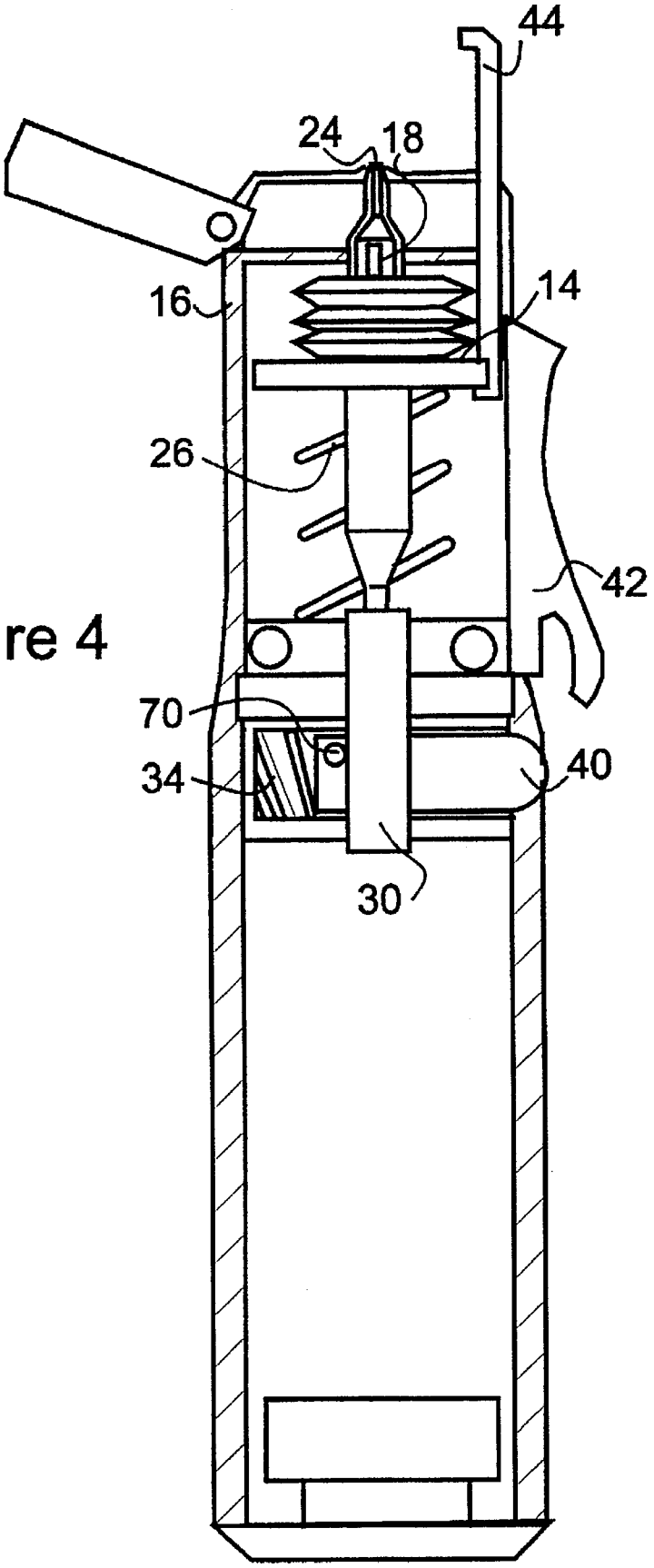
FIG. 4 is a cutaway front view of the protection device of the instant invention after use.

The personal protection device has been activated in FIG. 4. The sliding lock 42 was slid to the unlocked position and the trigger 40 depressed. The depression of the trigger 40 has moved the rod 32, removing the stop 70 from the stop notch 72 and releasing the ampule plunger 30. The spring 34 is compressed, the pressure maintaining the stop 70 against the ampule plunger 30. By releasing the ampule plunger 30, the spring 36 is allowed to expand, thereby forcing the ampule base 16 up toward the ejection nozzle 24. This action compresses the ampule 14, ejecting its contents through the nozzle 18. The force of the compression must be great enough to expel the contents from the ampule 14 in a stream approximately 10 foot long. Further the spring 26 must have sufficient force to continually expel the contents until at least seventy five percent (75%) of the contents are emptied from the ampule 14. The ampule contents are mixed in the mixing chamber 20 prior to expulsion from the ejection nozzle 24. As the spring 26 forces the ampule base 16 toward the nozzle 18, the reset bar 44 is also moved upward. Almost immediately upon upward movement, the reset bar 44 releases the cap 50, allowing it to swing to the open position. To reset the protection device either prior to complete expulsion or to add a new ampule, the reset bar 44 is pressed downward. This action causes the ampule plunger 30 to descend until the stop notch 72 is opposite the stop 70. The pressure created by the spring 34 forces the stop 70 into the stop notch 72, thereby locking the ampule base in the reset, or locked, position. Prior to returning the reset bar 44 to its original position, the cap 50 is closed, thus once the stop 70 is locking the plunger 30 into position, the reset bar 44 is properly placed in the detent 60, locking the cap 50.

FIGS. 5*a*, 5*b* and 5*c* illustrate in more detail the trigger 40 and the stop 70. As can be seen from these Figures, the rod 32 is provided with a stop 70. The spring 34 provides sufficient pressure on the rod 32 and stop 70 to maintain it against the stop notch 72. The configuration of the plunger 30 is such that a ledge is formed to receive the stop 70. The plunger 30 remains under pressure to move upward by spring 26, thereby continually applying pressure to the stop 70. When the trigger 40 is pressed, the rod 32 moves, removing the stop 70 from the stop notch 72. The plunger 30 is allowed to move upward to compress the ampule 14. Once the plunger 30 moves slightly, the stop 70 is no longer able to return to its unarmed position until reset as described heretofore. The spring 34 is compressed, therefore applying pressure on the plunger 30. The compression allows the stop to immediately return to the unarmed position once the reset rod 44 is depressed into position.

Figure 6:
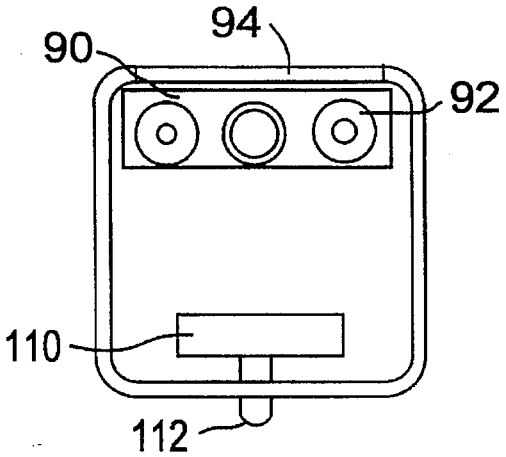
FIG. 6 is a cutaway view approximate the mid-point of the device of FIG. 1.

FIG. 6 illustrates the relationship between the ampule plunger 30 and the battery receiving area 90. The device 10 utilizes three triple "A" batteries 92 which are placed in the lower portion of the device 10 in the battery receiving area 90. The power of the batteries 92 can be checked in the unarmed mode by pressing the test button 112 inward causing the strobe light 54 to flash if the batteries 92 are good. This also serves to check on the brightness of the light 54, which is especially critical if the batteries 92 and ampule 14 have been replaced after use, possibly reducing the effectiveness of the light. Access to the batteries must be provided and can be accomplished in a number of methods. An access door 94 can be provided along the side of the device 10 or, alternatively the bottom of the device can unscrew to allow access to the batteries. Various methods of accessibility are known in the art and the examples set forth herein should not limit the scope of the invention.

Once activated the light 22 and alarm 26 continue to be activated until the batteries 42 lose power or the device 12 is opened and the batteries 42 disconnected. Alternatively, the light 22 and alarm 26 can be deactivated by the return of the reset bar 44 to the unarmed position. The alarm 26 and light 22 can be activated by a switch which senses the motion of either the trigger 40 or the movement of the ampule base 16. Other methods of activating the light 22 and alarm 26 will become apparent to those skilled in the art. The activation of the light 22 and alarm 26 can be either immediate upon depression of the trigger 40 or delayed for several seconds. By delaying the light 22 and alarm 26 activation, the user has a chance to expel the spray at the assailant without the distraction of the strobe or vibration and noise of the alarm. Since the delay would only be a couple of seconds, the strobe would still impair the attacker's vision. The delay also provides the advantage that the attacker would not be immediately able to pinpoint the location of the device.

Figure 7:
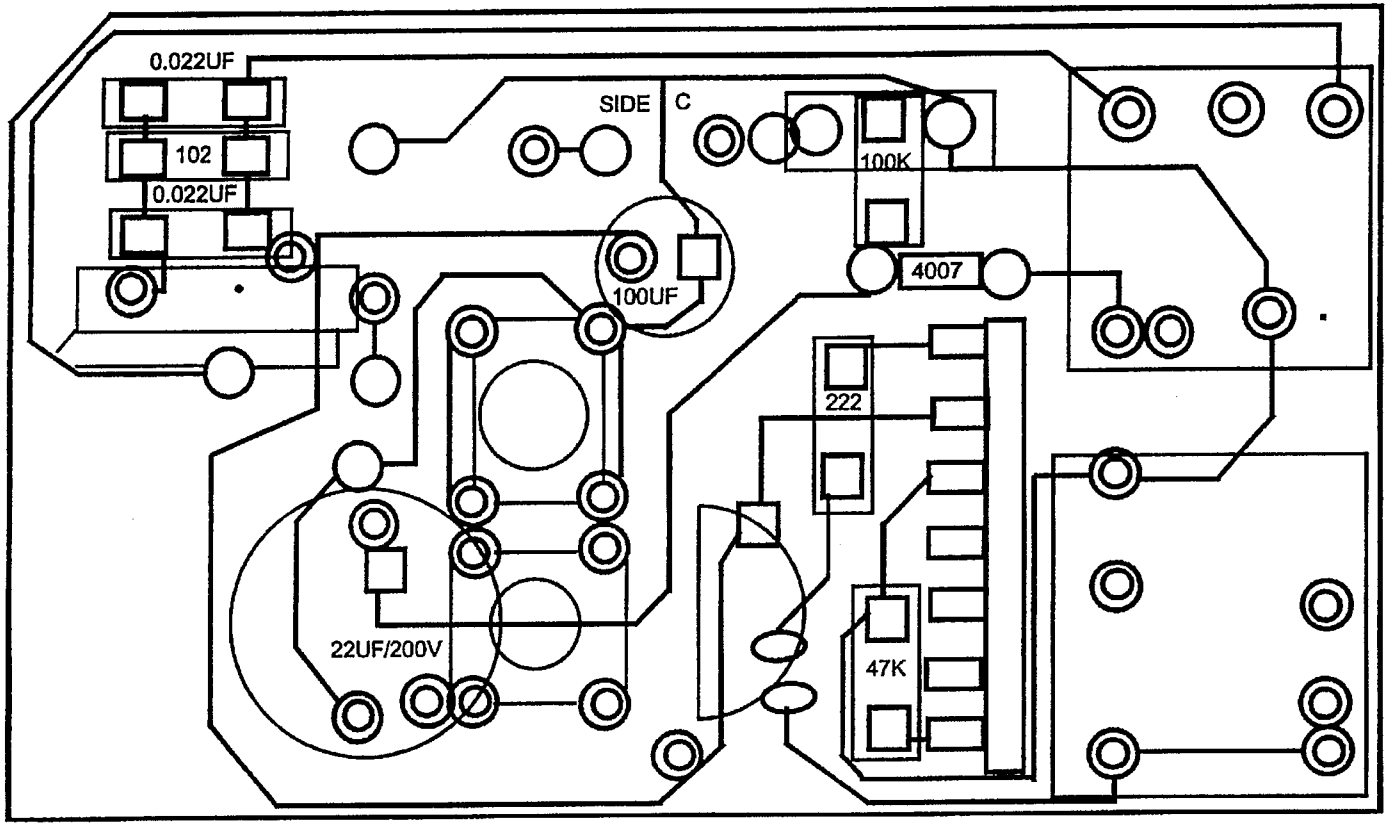
FIG. 7 is a schematic of the electronics of the instant invention.

The electronics 110 of the personal protection device 10 are illustrated in FIG. 7. The schematic illustrated herein is only one possible arrangement and alternate schematics can be designed by one versed in the art.

The interior of the ampule 14 is illustrated in FIG. 8. The ampule 14 are two independent units secured together, thereby allowing for the equal and immediate expulsion of the contents. The ampule 14 contains a combination of a deterrent spray, such as pepper spray which is derived from cayenne pepper, and a light activator glowing fluid. Certain deterrent sprays are illegal in various states, however the instant device can accommodate any of the liquid deterrent sprays commonly available, and use would be dependent upon the regulations within the state of purchase. In states where deterrent sprays are illegal, the ampule can contain only the glowing fluid for use in combination with the light and alarm. The chemical outline and description of the glowing fluid is described in the aforenoted parent U.S. Pat. No. 5,517,180.

Figure 9:
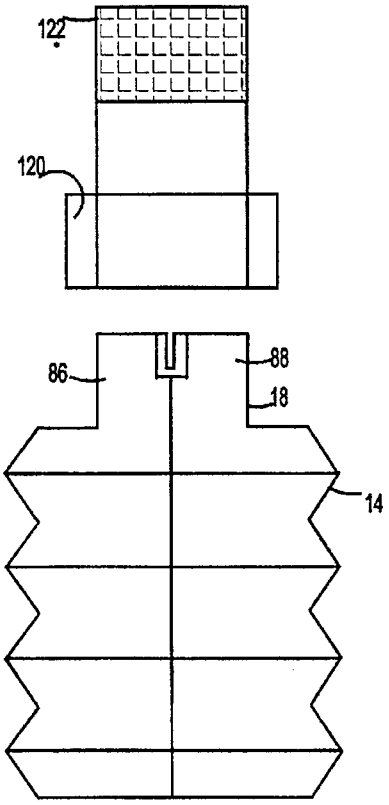
FIG. 9 is a cutaway side view of one embodiment of the ampule.

FIG. 9 illustrates the ampule 14 as it would be shipped and/or sold for replacement into the protection device 10. The ampule 14 is shipped with a ring cap 120 which is dimensioned to tightly friction fit with the combined nozzle 18 of the ampule 14, connecting the combined nozzle 18 and the sealing rubber 122. The sealing rubber 122 is placed in the ring cap 120 opposite the combined nozzle 18 and depressed until the sealing rubber 122 comes in contact with the combined nozzle 18. This method seals the nozzles 86 and 88, preventing the liquids from leaking from the ampule 14. Immediately prior to installation, both the sealing rubber 122 and the ring cap 18 are removed to expose the nozzles 86 and 88. The ampule coupler 22 is placed over the nozzle 86 and 88, and is locked to the ampule 14 through friction fit between the interior of the ampule coupler 22 and the combined nozzle 18. An installation door 57, shown in FIG. 2, is one method of accessing the ampules for replacement. Other methods will become apparent to those skilled in the art. Once the new ampule 14 is installed, the lid 50 is closed with the plug 58 maintaining the integrity of the unit.

Figure 10:
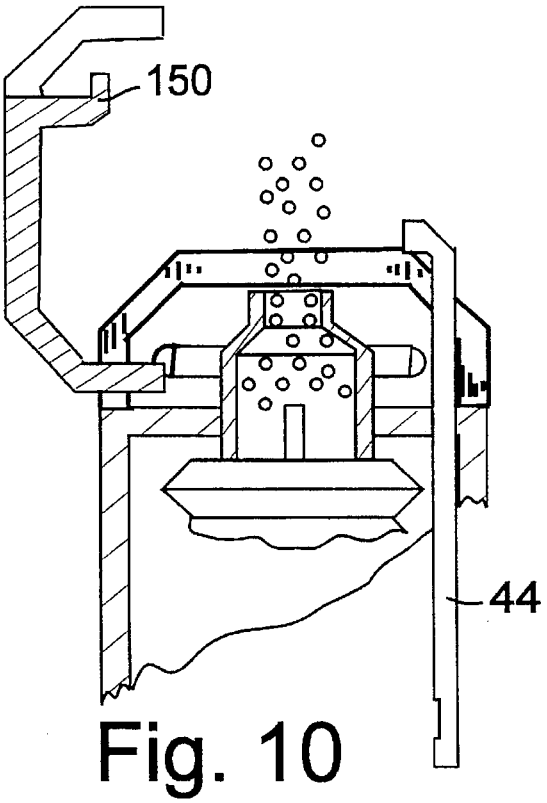
FIG. 10 is a cutaway side view of the cap locking mechanism.
Figure 11:
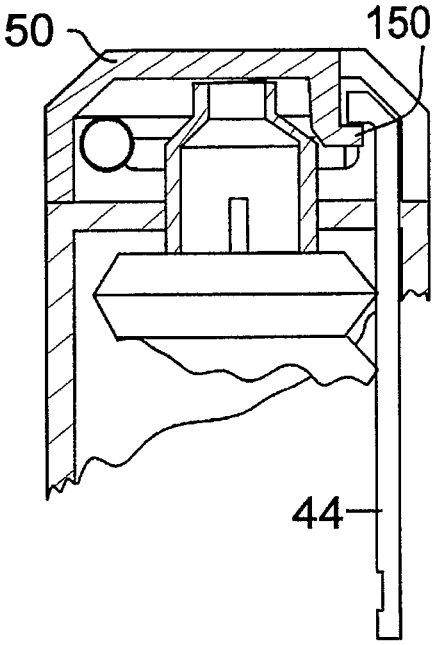
FIG. 11 is a cutaway side view of the cap in the locked position.
Figure 15:
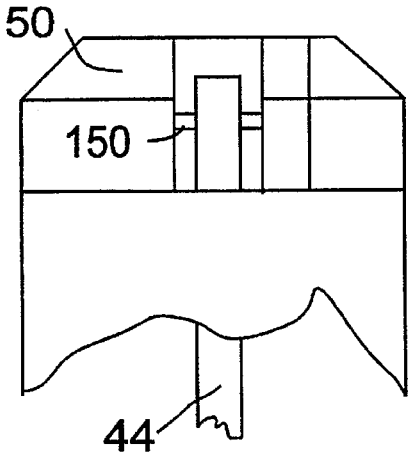

FIGS. 10, 11 and 15 illustrate more clearly how the reset bar 44 is utilized to maintain the cap 50 in the closed position as well as allow for automatic opening upon activation. The reset bar 44 locks onto the detent flange 150. As the reset bar 44 is released and raised, in response to the depression of the trigger, one side of the cap 50 is also raised. As the cap 50 is raised, it pivots and releases the reset bar 44 from the detent flange 150, allowing the cap 50 to swing open. Other means for restraining and subsequently automatically opening the cap in response to the trigger will be come apparent to those skilled in the art.

Figure 12:
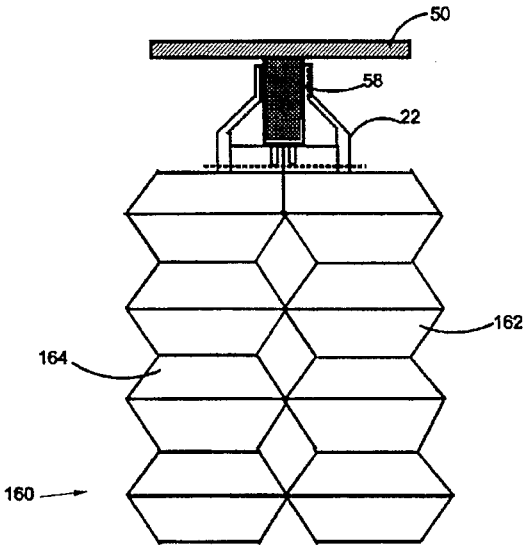
FIG. 12 is an alternate embodiment of the ampule.

FIG. 12 illustrates an alternate ampule configuration 160. In this embodiment the ampules 162 and 164 are identical separate accordion shaped units which are maintained as a single unit through the ampule coupler 22. The stopper 58 can also be seem clearly fitting into the ampule coupler 22 to prevent spillage of the contents.

Figure 13:
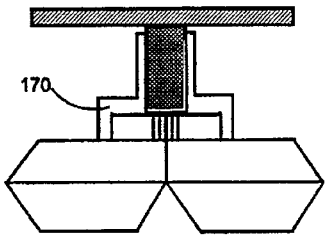
FIG. 13 is an alternate embodiment of the ampule coupler.

FIG. 13 illustrates an alternate embodiment to the ampule coupler 22. The square coupler 170 serves the same purpose as the coupler 22 although not as much mixing space is provided. Other coupler configurations can be used and the foregoing examples should, in no way, limit the scope of the invention.

The glowing fluid used herein is known as Lightstick Activator Component sold by Omniglow Corporation. The glowing liquid contains Butanol, t-, Dimetyl phthalate and hydrogen peroxide and is commonly used in lightsticks. The chemicals are stored separately and are activated once they are mixed, glowing for at least one hour. By spraying the glowing liquid along with the spray, the assailant is identified for possible apprehension. The advantage of the glowing liquid versus paint is the glowing liquid does glow in the dark. This makes it more difficult for the attacker to hide.

The light activator glowing fluid disclosed heretofore causes some eye and skin irritation, however this irritation is moderate and no permanent damage should result to the attacker. As an alternative to the glowing fluid, any type of light reflecting paint, either in bright yellow, orange, or red, can be used in the device. If materials are used which can be combined, the ampules can be reduced to two, or even one, compartment. The light activator glowing fluid provides the benefit that it does not require an external source of light for visibility.

The outer shell of all ampules, whether or not illustrated herein, must be of a pliable material which will not break but rather bend. This flexibility allows for the required ease of compression.

FIG. 14 illustrates an alternate embodiment to the instant invention. The flexible ampule 14 described heretofore has been replaced by canister 910. The canister 910 is filled under pressure with pepper spray, or other deterrent. The release of the contents within the canister 910 is activated through a pressure valve 920, as known in the art. As the plunger 30 is released, pressure is applied to the valve 920 by the pressure point 912. The pressure point 912 replaces the mixing area previously described and allows for the expulsion of the contents of the canister 910. The canister embodiment 900 is activated and deactivated in the same manner as the device of FIG. 1.

The combination of the four way safety: the pepper spray, the glowing fluid, flashing light and sound device renders the device very effective against any potential attackers. The layering of the protective pepper spray, the glowing fluid, and the light and sound device provides backup and redundant protection. The glowing fluid, although not an immediate deterrent, is an "ongoing" indication of the potential guilt of the person. The glowing fluid will continue to mark the person's clothing even after the flowing has stopped. This works as an indicator to police that this person may have been involved in illegal activities. For example, if the victim is unable, due to the suddenness of an attack, to hit the attacker with the pepper spray to incapacitate the attacker, the victim has other opportunities for deterrence. The glowing fluid is simultaneously sprayed on the attacker and the flashing light and sound device triggered which provide additional high measures of protection. All that is necessary for the triggering of the flashing light and sound device is the simple depression of the trigger button. While the victim may not succeed in hitting the attacker with the pepper spray and glowing fluid, the victim should have the opportunity to activate the light and sound device by pressing the trigger button. The utilization of only one spray opportunity against a potential attacker allows the device to be sized conveniently for the average user and can easily fit in the palm of one's hand.

An example of use would be a woman might leave her place of work to walk to her parked car several blocks away. Prior to her reaching the street she could slide the lock upward, thereby rendering the device capable of being fired with an easy depression of the trigger button. Once she has safely reached her destination the sliding lock would then be returned to the unarmed position, thereby deactivating the device.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A personal protection device, said personal protection device comprising:

a body section, said body section having a first end and a second end, said body section having an container section proximate said first end, a mixing area, said mixing being proximate said first end and having a mixing nozzle extending trough said first end, a fluid container, said fluid container resting on a movable container base and having a nozzle extending into said mixing area, compression means, said compression means being positioned proximate said container base, locking means, said locking means maintaining said compression means in a non-compressed position, trigger means, said trigger means being proximate said locking means, a light, said light being proximate said first end, a battery receiving area, said battery receiving area being proximate said locking means, alarm means, electronic means, said electronic means being connected to said battery receiving area, said trigger means, said alarm means and said light, movable safety means, said movable safety means being proximate said trigger means, preventing access to said trigger means when in the unarmed position and allowing access to said trigger means when in the armed position, safety cap, said safety cap being held in the unarmed position by a reset bar, said reset bar being in contact with said compression means, wherein placing said safety means in the armed position and depressing said trigger means releases said locking means and enables said compression means to compress said container and release said safety cap, thereby expelling under force the contents of said container into said mixing area and out of said protection device.

2. The personal protection device of claim 1 wherein said light, once activated, repeatedly flashes on an off.

3. The personal protection device of claim 1 wherein said alarm means, once activated, is intermittent.

4. The personal protection device of claim 1 wherein at least a portion of said first end of said container portion is removable, thereby allowing access to said fluid container.

5. The personal protection device of claim 1 wherein a section of said body portion proximate said battery receiving area is removable, thereby allowing access to said battery receiving area.

6. The personal protection device of claim 1 wherein said safety cap further includes a spring hinge.

7. The personal protection device of claim 1 wherein said safety cap further includes a plug portion, said plug portion being dimensioned to fit within said mixing area nozzle.

8. The personal protection device of claim 1 wherein said electronic means controls said light and said alarm means, causing said light and said alarm means to pulse simultaneously.

9. The personal protection device of claim 8 wherein activation of said trigger means causes said electronic means to immediately activate said light and said alarm means.

10. The personal protection device of claim 8 wherein activation of said trigger means causes said electronic means to delay activation said light and said alarm means by a predetermined time period.

11. The personal protection device of claim 1 wherein said fluid container is a canister.

12. The personal protection device of claim 11 wherein said canister contains an irritative substance.

13. The personal protection device of claim 1 wherein said fluid container is a flexible ampule.

14. The personal protection device of claim 13 wherein said ampule further comprises two mirror image sections, each of said two mirror image sections having nozzles extending into said mixing area.

15. The personal protection device of claim 14 wherein a first of said two mirror image sections contains an irritative substance.

16. The personal protection device of claim 15 wherein said irritative substance is pepper fluid.

17. The personal protection device of claim 14 wherein a first of said two mirror image sections contains the first part of a two part marking substance.

18. The personal protection device of claim 17 wherein the second part of said two part marking substance is maintained in the second of said two mirror image sections and the compression of said ampule allows said first part and said second part of said marking substance to mix in said mixing area prior to expulsion from said protection device.

19. The personal protection device of claim 17 wherein said marking substance is a glowing fluid.

* * * * *